US012070783B2

(12) United States Patent
Steinmetz et al.

(10) Patent No.: US 12,070,783 B2
(45) Date of Patent: Aug. 27, 2024

(54) METHOD AND APPARATUS FOR AXIALLY SHAPING A TUBE

(71) Applicant: Walter Henrich GmbH, Daaden (DE)

(72) Inventors: Uwe Steinmetz, Steinebach (DE); Bernd Henrich, Daaden (DE)

(73) Assignee: Walter Henrich GmbH, Daaden (DE)

( * ) Notice: Subject to any disclaimer, the term of this patent is extended or adjusted under 35 U.S.C. 154(b) by 383 days.

(21) Appl. No.: 17/431,149

(22) PCT Filed: Feb. 10, 2020

(86) PCT No.: PCT/EP2020/053307
§ 371 (c)(1),
(2) Date: Aug. 13, 2021

(87) PCT Pub. No.: WO2020/165082
PCT Pub. Date: Aug. 20, 2020

(65) Prior Publication Data

US 2022/0134401 A1 May 5, 2022

(30) Foreign Application Priority Data

Feb. 15, 2019 (DE) ..... 10 2019 103 926.6

(51) Int. Cl.
*B21C 37/16* (2006.01)

(52) U.S. Cl.
CPC ..... *B21C 37/16* (2013.01)

(58) Field of Classification Search
CPC .. B21C 37/16; B21C 1/16; B21C 1/18; B21C 1/22; B21C 1/24; B21C 1/26
USPC ..... 72/370.04
See application file for complete search history.

(56) References Cited

U.S. PATENT DOCUMENTS 2,535,339 A 12/1950 Woeller
2,998,125 A 8/1961 Hahn et al.
5,119,662 A * 6/1992 Sunaga ..... B21C 1/24 72/283

(Continued)

FOREIGN PATENT DOCUMENTS

AD 1905 * 7/1905
CN 101121182 A 2/2008

(Continued)

OTHER PUBLICATIONS

Fertigungstechnik von Fritz Schulze, Springer Vieweg Verlag, p. 445.

*Primary Examiner* — Debra M Sullivan
(74) *Attorney, Agent, or Firm* — Smartpat PLC

(57) ABSTRACT

A method and an apparatus for axially shaping a tube use a mandrel guided in the tube and an annular die guided on the outside of the tube. The tube is clamped in a clamping device. The outer diameter of the tube is reduced by moving the annular die in a pushing direction. In order to form undercuts on the outside and inside of the tube the method uses the following steps: Reversing the direction of movement of the die and the mandrel upon reaching an end position from the pushing direction to an opposite pulling direction. In a first setting step, the die and the mandrel are then moved in relation to one another to a first preset annular-gap setting, and in a subsequent first shaping step, the die and the mandrel are moved in the pulling direction, while maintaining the preset annular gap.

12 Claims, 18 Drawing Sheets

(56) References Cited

U.S. PATENT DOCUMENTS

| | | | |
|---|---|---|---|
| 6,779,375 | B1 | 8/2004 | Alexoff |
| 2008/0115553 | A1 | 5/2008 | Brochheuser et al. |
| 2009/0158799 | A1 | 6/2009 | Takeishi et al. |
| 2010/0289318 | A1 | 11/2010 | Le et al. |
| 2011/0260423 | A1 | 10/2011 | Lepre |
| 2016/0146250 | A1 | 5/2016 | Thumm et al. |
| 2019/0076902 | A1 | 3/2019 | Mizumura et al. |

FOREIGN PATENT DOCUMENTS

| | | | | |
|---|---|---|---|---|
| CN | 102177036 | A | 9/2011 | |
| CN | 102357546 | A | 2/2012 | |
| CN | 104722701 | A | 6/2015 | |
| DE | 3016135 | A1 | 10/1981 | |
| DE | 3021481 | A1 | 12/1981 | |
| DE | 3506220 | A1 | 8/1986 | |
| DE | 102014017426 | A1 | 5/2016 | |
| EP | 3427852 | A1 | 1/2019 | |
| GB | 190515351 | A | 11/1905 | |
| WO | 2006053590 | A1 | 5/2006 | |
| WO | 2006088138 | A1 | 8/2006 | |
| WO | WO-2006088138 | A1 * | 8/2006 | ..... B21C 1/24 |
| WO | 2010117920 | A1 | 10/2010 | |

* cited by examiner

METHOD AND APPARATUS FOR AXIALLY SHAPING A TUBE

CROSS-REFERENCE TO RELATED APPLICATION

This application is a national stage application, filed under 35 U.S.C. § 371, of International Patent Application No. PCT/EP2020/053307, filed on 2020 Feb. 10, which claims the benefit of German Patent Application No. 10 2019 103 926.6, filed 2019 Feb. 15.

TECHNICAL FIELD

The disclosure relates to a method and an apparatus for the axial shaping of a tube with the aid of a mandrel, which is guided in the tube, and an annular die, which is guided on the outside of the tube.

BACKGROUND

The axial shaping of tubes has been established in the metal industry for decades. Indents, flares and special contours, such as toothings, squares, etc., are among the standard applications. Axial shaping means resource efficiency, an uninterrupted fiber flow, strain hardening of the tube material and good surface quality of the shaped regions. The main field of application for the axial shaping of tubes is the production of components for the automotive industry and general mechanical engineering. Axial shaping can also be used to easily produce lightweight components in particular; this is why axial shaping is also coming into play in current topics such as electromobility and the reduction of CO2 emissions. Shaping is performed with the aid of a mandrel guided in the tube and an annular die guided on the outside of the tube, the inside diameter of which is, as a rule, smaller than the original outside diameter of the tube. The energy for the shaping work is provided by both hydraulic and electromechanical systems.

A sub-case of general tube shaping is the so-called "axial stretching" or "stretch forming," as the case may be, of the tube; see for example the technical book entitled "Fertigungstechnik von Fritz Schulze, Springer Vieweg Verlag, 10th edition, page 445, Chapter 5.4.3. During axial stretching, the annular gap between the die and the mandrel is typically set to a distance that is smaller than the original wall thickness of the tube to be shaped. The tool pair of die and mandrel is then guided in the axial direction along the tube to be shaped, reducing the wall thickness of the tube accordingly.

Each of the printed publications DE 30 16 135 A1, DE 30 21 481 A1, DE 35 06 220 A1 and U.S. Pat. No. 6,779,375 B1 disclose a method for the axial shaping of a tube.

An example of tube shaping can also be found disclosed, for example, in international patent application WO 2006/053590 A1. A method for producing hollow shafts with end portions of greater wall thickness, and with at least one intermediate portion of reduced wall thickness from a tube with originally constant wall thickness, is described therein. Production is carried out by initially inserting a mandrel with a diameter graduated along its length into the tube to be shaped and then moving a ring die from the side with the tapered diameter of the mandrel in the longitudinal direction over the tube with the internal mandrel. Thereby, the outer diameter of the original tube is initially reduced, and at the same time the displaced material of the tube is forced into the annular gap between the annular die and the stepped mandrel. Due to the gradation of the mandrel, this creates stepped undercuts inside the tube. The inner contour of the tube created in this manner corresponds in a complementary manner to the profile of the stepped mandrel. Over the graduated regions of the mandrel, this creates undercuts inside the tube, which typically have a greater wall thickness than the original tube. If the annular gap between the die and the portion of the mandrel with the largest outside diameter is smaller than the original wall thickness of the mandrel, the stretching of the tube occurs in this region, reducing the original wall thickness to a smaller wall thickness.

A disadvantage of the procedure known from WO 2006/053590 A1 is that the formation of undercuts inside the tube is only possible with individual discrete wall thicknesses, to the extent that this is specified by the gradations in the outer diameter of the mandrel. In addition, the formation of a plurality of undercuts on the outside in the longitudinal direction of the tube is not possible.

SUMMARY

The invention is based on the object of further developing a known method and a known apparatus for shaping a tube in such a way that it is possible to form undercuts both on the inside and on the outside of the tube with a wall thickness that can be variably set within limits.

The object is achieved by the method as disclosed in this application. It is characterized in that, when an end position of the die is reached with the mandrel leading, the following steps are carried out: Reversing the direction of movement of the die and mandrel from the pushing direction to an opposite pulling direction; First setting step: Moving the die and mandrel in relation to one another to a first preset annular-gap setting; and first shaping step: Moving the die and mandrel in the pulling direction over a first partial portion of the free tube portion, while maintaining the first preset annular-gap setting, for shaping the tube.

The first setting step and any subsequent setting steps allow the die and the mandrel to be moved in relation to one another and thus the annular gap between the die and the mandrel to be variably set to any desired dimension—preferably limited to the original outside diameter as a maximum. Due to the presence of conical transition portions with both the annular die and the mandrel, undercuts are possible in the shaping region of the tube, particularly within the original tube wall thickness, because of the variable setting of the annular gap. Depending on whether the conical transition portions taper or flare towards the free end of the tube, the undercuts are possible on the inside and/or outside of the tube. The formation of undercuts on the inside of the tube and on the outside of the tube can be realized in one operation on one and the same tube on different longitudinal portions in each case. As a sub-case of this, a thick-thin tube with a constant inner bore can also be realized, with which only local undercuts are formed on the outside. Alternatively, thick-thin tubes can be formed with a constant outside diameter, but with undercuts inside the tube with different wall thicknesses on request.

The undercuts are formed by moving a tool pair of die and mandrel, preset with respect to the annular gap, over a partial portion of the free tube portion. The die and mandrel are moved in the pulling direction to form the undercuts, that is, when the tool pair is moved towards a shaping device, in which the die and mandrel are displaceably mounted and controlled. In particular, "pulling direction" also means a direction in which the tube to be shaped is subjected to tensile load. In contrast to moving the die and mandrel in a pushing direction, which is opposite to the pulling direction, there is no risk of the tube being deformed in an undesirable way, in particular compressed or bent, when the die pair is moved in the pulling direction.

Advantageously, the claimed method enables the creation of completely different geometries on the tubes with regard to diameter tolerances and work thicknesses by means of program-controlled shaping sequences, without the geometries of the tools, that is, the die and the mandrel, having to change during the shaping process. The method allows the use of simple (pre-) tubes, which did not already have to be pre-shaped in separate method steps, and thus better value-added potential in component production. The use of forward and backward movements of the die—mandrel tool pair for shaping the tube signifies resource efficiency. The method allows a targeted reduction of the wall thickness of the tubes in limited local tube portions according to a previously made design layout. The local reduction of the wall thickness of a tube may be desired, for example, to introduce a predetermined breaking point. Another advantage is the possibility of using inexpensive pre-tubes in accordance with the German Industry Standard DIN EN 10305-3 instead of the previously required tubes of a more expensive quality according to the standard DIN EN 10305-2.

The term "free tube portion" means: unclamped tube portion.

The terms "push" or "pushing direction" mean a direction away from a shaping device, from which the die and mandrel are moved, and towards a clamping device. In particular, the pushing direction means a direction in which the tube to be shaped is subjected to pressure.

The term "pulling direction" means a direction opposite to the pushing direction. With the pulling direction, the tube to be shaped is always subjected to tensile load. There is no risk of compressing or bending the tube. However, when shaping in the pulling direction, there is a risk of fracture or cracking of the tube to be shaped if the tensile load becomes too great.

The term "synchronous" in the present description means the movement of die and mandrel at the same speed in the same axial direction. Synchronous travel always takes place with a fixed annular gap. Changing the size of the annular gap always requires relative movement of the die and mandrel at different speeds, which precludes the synchronous movement of the die and mandrel.

The term "vertical" refers to the y-direction of the coordinate system, as shown in FIG. 1.

The term "negative annular gap" means that annular gap that is spanned by the conical transition portions of the die and mandrel that taper towards the free end of the tube or towards the mandrel bar or towards the shaping device, as the case may be, in the figures. Independently of this, the conical transition flanks of the die and mandrel can be designed to converge, be parallel or diverge in relation to one another. Thereby, the conical transition portions can overlap or oppose each other, as the case may be, at least a short distance in the vertical direction. In the figures, the mandrel is then offset to the left with respect to the die. In other words, the negative annular gap—viewed in the pulling direction—is located on the rear side of the die. Machining the tube with a negative annular gap results in the formation of an undercut on the outside of the tube.

The term "minimum annular gap" means an annular gap with a minimum vertical distance between the die and the mandrel. It is formed in particular between the narrowest point of the annular die and an opposite, usually cylindrical (transition) portion of the mandrel. As a rule, the die—mandrel tool pair is selected prior to the beginning of tube shaping, such that the minimum annular gap dimension corresponds to a later desired minimum wall thickness of the tube to be shaped. The minimum wall thickness is usually selected to be less than or equal to the original wall thickness of the tube. It can be realized later by axial stretching of the tube.

The term "positive annular gap" means an annular gap that is expanded by the conical transition portions of the die and mandrel flaring in the figures towards the free end of the tube or towards the mandrel bar or towards the shaping device, as the case may be. Independently of this, the conical transition flanks of the die and mandrel can be designed to converge, be parallel or diverge in relation to one another. Thereby, the conical transition portions can face each other in the vertical direction, at least to some extent. In the figures, the mandrel is then offset to the right with respect to the center of the die. In other words, the positive annular gap—viewed in the pulling direction—is located on the front side of the die. Machining the tube with a positive annular gap results in the formation of an undercut on the inside of the tube.

In accordance with a first exemplary embodiment, after the first shaping step, the sequence of steps, setting step and subsequent shaping step, can be repeated as often as desired, in which case the annular gap can be re-set at each further setting step. Such repeatability of the steps allows multiple undercuts to be shaped on the inside and outside of the tube, distributed over the longitudinal direction of the free tube portion to be machined.

The provision of a cylindrical portion in the longitudinal direction of the mandrel makes it possible to set the minimum annular gap between the die and the mandrel, if the specified cylindrical portion with the maximum outer diameter of the mandrel faces the narrowest point of the annular die. If the die and the mandrel are moved in this relative position to each other in the longitudinal direction of the tube, the axial stretching of the tube takes place if the set minimum annular distance between the die and the mandrel is smaller than the upstream wall thickness of the tube in the pulling direction.

Alternatively, the annular gap between the mandrel and die can be set negatively or positively to form an undercut on the inside or outside of the tube.

Depending on the current situation and the previous shaping of the tube, the relative movement of the die and mandrel can take place in different ways within the framework of the setting steps. Specifically, with the first claimed setting step, with which the direction of movement of the die and mandrel is reversed, it is useful for the die to be stopped for a brief period of time and then for only the mandrel to be moved relative to the die, in order to set the desired annular gap. In other situations, it may be useful to continue moving the die continuously in the pulling direction and to change the setting of the annular gap by moving the mandrel relative to the moving die. In other situations, it may be useful to move the die temporarily a short distance in the opposite direction to the pulling direction, that is, in the pushing direction, while the mandrel remains stationary, in order to adjust the annular gap as desired.

Both for shaping the undercuts in the inner and outer regions of the tube and for carrying out the aforementioned axial stretching of the tube, the die and the mandrel typically move synchronously with each other while maintaining a previously undertaken setting of the annular gap. The die and mandrel are moved synchronously until a desired length portion of the tube to be shaped, in which the respective undercuts or stretchings are to be made, has been run.

It is particularly advantageous if the method is used to alternately carry out the formation of undercuts and the stretching of the tube in the longitudinal direction of the tube on the tube portion to be shaped.

The above-mentioned object of the invention is further achieved by an apparatus for carrying out the method. The advantages of this apparatus correspond to the advantages mentioned above with reference to the claimed method.

The control device required for carrying out the method for the individual control of the die and mandrel is designed as an electronic controller, in particular for the individual setting of the annular gap for realizing the undercuts and the stretching. However, for setting the minimum annular gap, as required in particular for the axial stretching of the tube, the control device can also be designed in the form of a mechanical forced coupling. Compared to an electronic control system, the formation of a mechanical forced coupling is particularly simple and robust. Finally, it is advantageous if the mandrel is designed to be profiled—in particular in the longitudinal direction. With the aid of a profiled formation of the mandrel, for example if the mandrel has a gearwheel-shaped cross-section, longitudinal grooves can be drawn in or formed, as the case may be, on the inside of the wall of the tube with such mandrel.

BRIEF DESCRIPTION OF THE DRAWINGS

The description is accompanied by 18 figures.

DETAILED DESCRIPTION

The invention is described in detail below with reference to the above figures in the form of exemplary embodiments. In all figures, the same technical elements are designated with the same reference signs.

Figure 1:
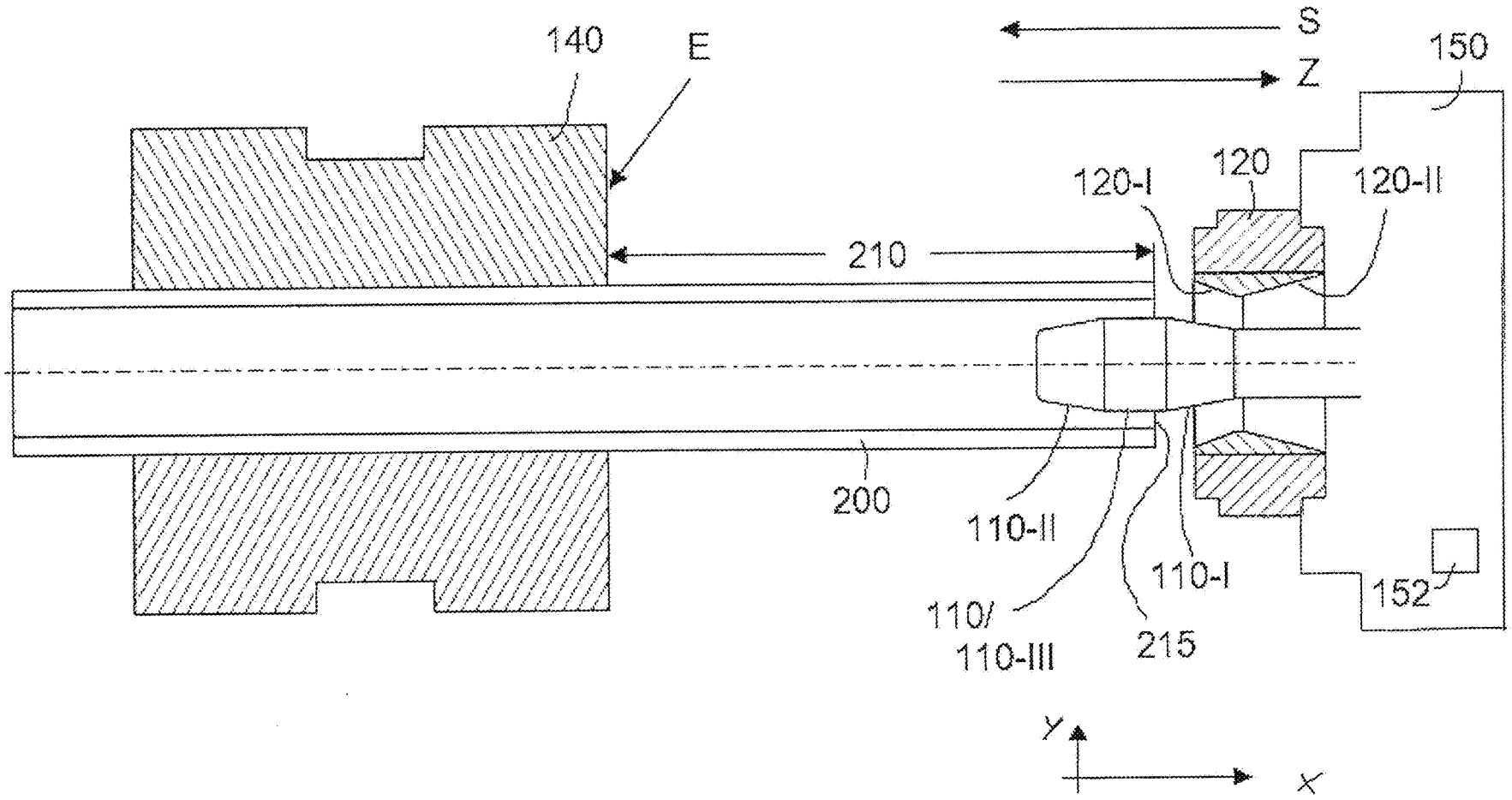
FIG. 1 shows the apparatus for carrying out the method in an initial position.

FIG. 1 shows the apparatus in accordance with the invention. It includes a clamping device 140 for clamping a tube 200 to be shaped, such that a free portion 210, that is, a portion of the tube 200 that is not a clamped portion, remains for shaping. At the free end of the tube 200, a shaping device 150 can be seen, in which an annular die 120 and a mandrel 110 arranged coaxially thereto are displaceably mounted. In the exemplary embodiment shown herein, the die 120 includes two conical transition portions on the inside, a first transition portion 120-I of which tapers towards the free end of the tube 200 and a second transition portion 120-II of which flares towards the free end of the tube 200. The mandrel 110 has a first conical transition portion 110-I on its outside, which tapers towards the free end of the tube 200 and towards the shaping device 150, and a transition portion 110-II that flares towards the free end of the tube 200 and towards the shaping device 150. A cylindrical transition portion 110-III with a constant maximum outer diameter is formed in between. The pairing of annular die 120 and mandrel 110 is selected such that the minimum distance between the die at its narrowest point and the cylindrical portion 110-III of mandrel 110 having maximum outside diameter is less than or equal to the original wall thickness of the tube 200.

In order to carry out the method in accordance with the invention, it is not absolutely necessary that each of the die 120 and the mandrel 110 has two conical transition portions. To realize undercuts 220, 240 on the outside of the tube 200, only the conical transition portions on the die 120 and mandrel 110, which taper towards the free end of the tube 215, are required. To form undercuts 220, 240 only inside the tube 200, only the transition portions on the die 120 and mandrel 110, which flare towards the free end 215 of the tube and towards the shaping device 150, are required. If only a stretching of the tube 200 is desired, only the presence of the cylindrical portion 110-III at the mandrel 110 with a maximum outside diameter without conical transition portions is required. Depending on the desired shaping of the tube 200, the die 120 and the mandrel 110 must be selected in each case with the correspondingly necessary transition portions and minimum annular gap.

A control device 152 is allocated to the shaping device 150 for moving the die 120 and the mandrel 110 independently of each other along the free portion 210 of the tube 200 in a pushing direction S and a pulling direction Z. When the die 120 is moved in the pushing direction, the tube 200 is subjected to compression and there is a risk of bending and compression of the tube 200. When the die 120 and mandrel 110 are moved in the pulling direction, there is a risk of the tube 200 tearing, in particular if the annular gap is set too narrow.

FIG. 1 shows the initial position of mandrel 110 and die 120 for carrying out the method. The mandrel 110 and die 120 are located at the free end of the tube 200 and aligned coaxially with it. The mandrel 110 has already moved a short distance into the free end of the clamped tube 200.

Figure 2:
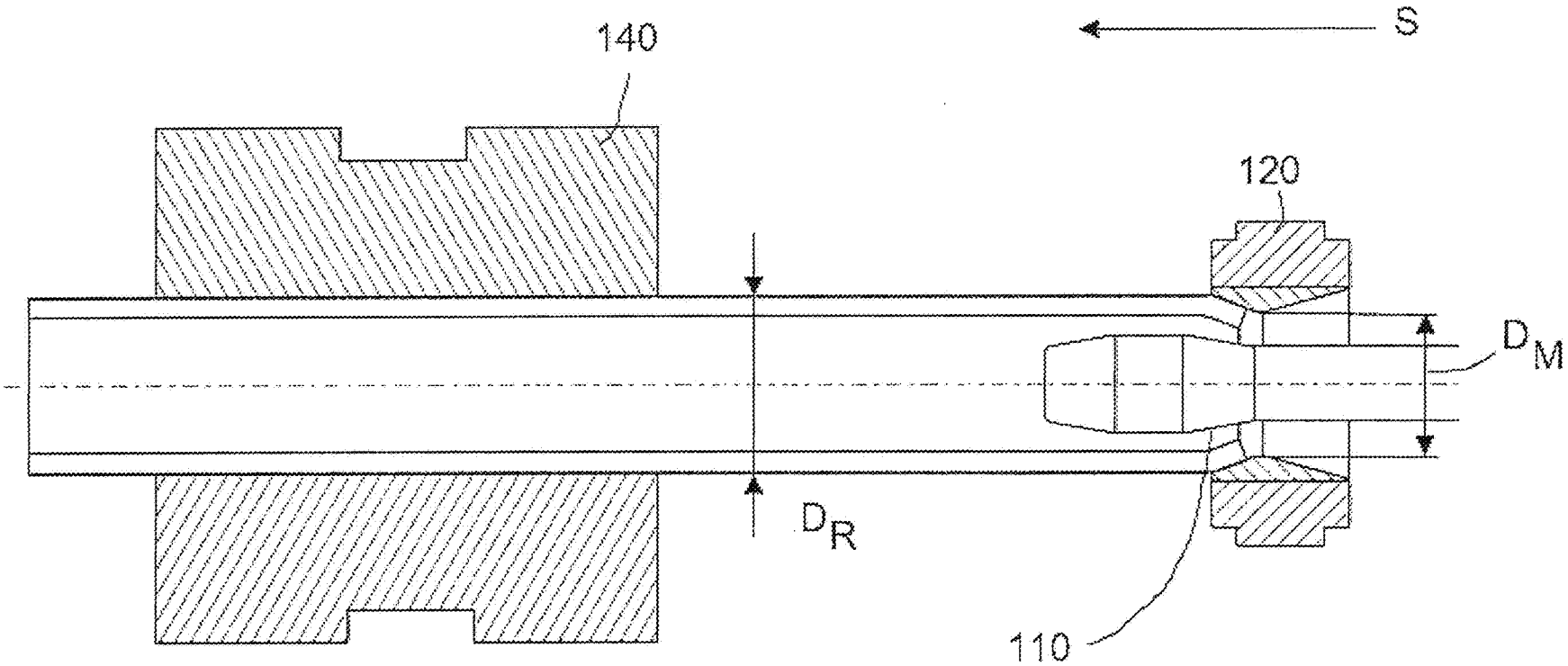
FIG. 2 shows the mandrel and die in an initial position for reducing the outside diameter of the tube.

FIG. 2 shows the beginning of a desired reduction of the outer diameter of the tube 200 by pushing the annular die 120 in the pushing direction S towards the clamping device 140. Given that the smallest clear inside diameter $D_M$ of the die 120 is smaller than the outside diameter $D_R$ of the tube 200, the desired reduction of the outside diameter occurs when the die 120 is moved in the pushing direction. Thereby, the wall of the tube 200 slides along the transition portion 120-I of the die 120. The mandrel 110 thereby precedes the die 120 in the pushing direction S; it is not involved in the shaping process itself in that its surface does not contribute to the shaping, that is, specifically to the reduction of the outer diameter. During this shaping process, it serves at most to guide and support the tube 200 against bending.

In contrast to the subsequent shaping step, with which the die 120 and the mandrel 110 are moved in the pulling direction, the annular gap between the die 120 and the mandrel 110 is not important when the outer diameter is reduced by moving the die 120 in the pushing direction; its size is irrelevant; in particular, the mandrel 110 can advance so far in front of the die 120 that a conical transition portion of the mandrel 110 facing the die 120 has no influence on the wall of the tube 200 if the latter is reduced by the movement of the die 120.

Figure 3:
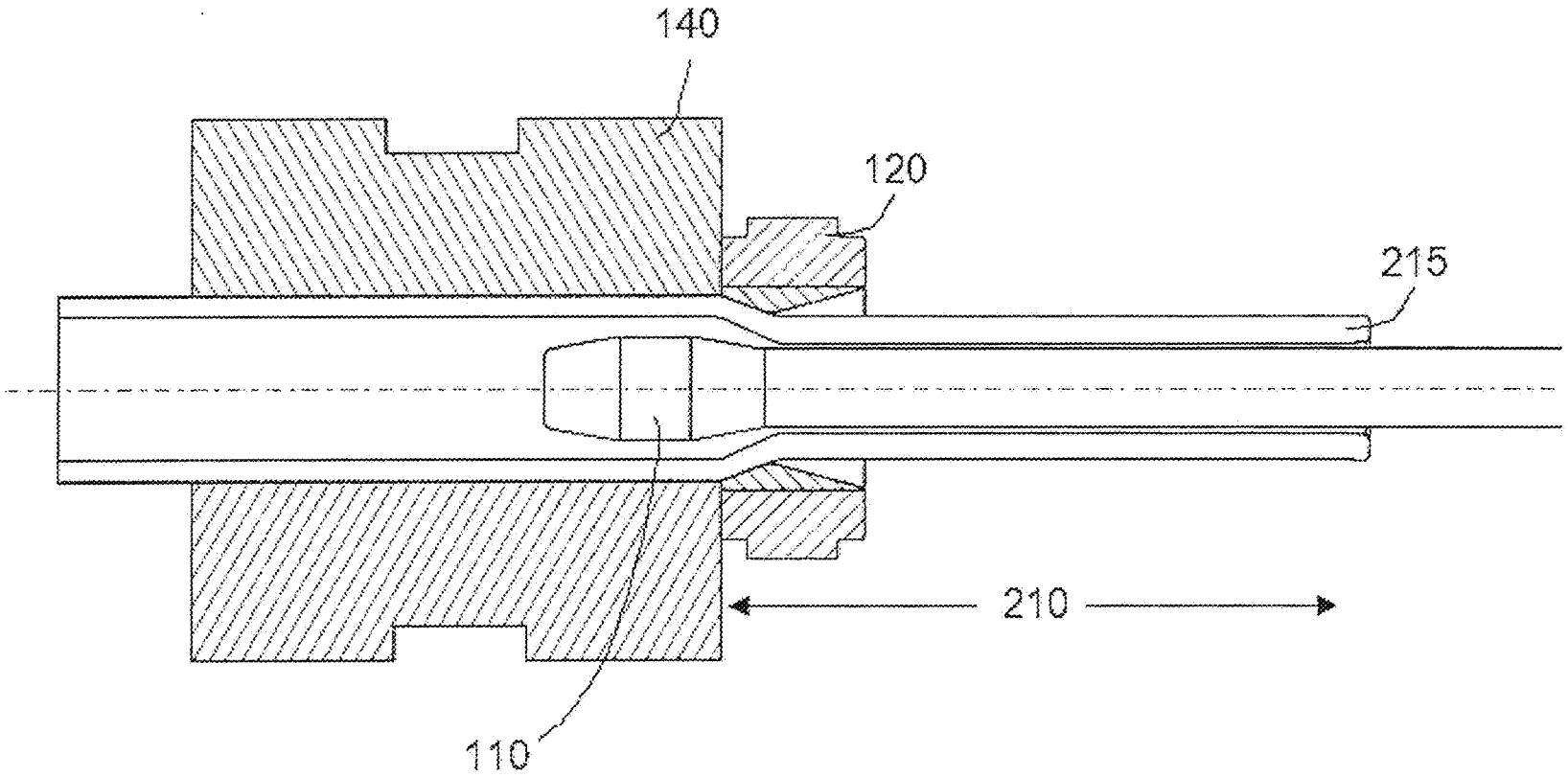
FIG. 3 shows the die and mandrel in an end position after reduction of the outside diameter of the tube.

In accordance with FIG. 3, the reduction of the outer diameter $D_R$ of the tube 200 occurs over an essential part of the free portion 210, specifically in this case until the die 120 abuts the clamping device 140. Of course, the end of the reduced tube portion defined in this way is merely exemplary; in fact, the reduction of the tube 200 can end even before it reaches the clamping device 140.

In FIG. 3, it can be clearly seen that the material displaced during the reduction of the outer diameter results in an increase in the wall thickness of the tube 200 in the region of the reduced outer diameter.

Figure 4:
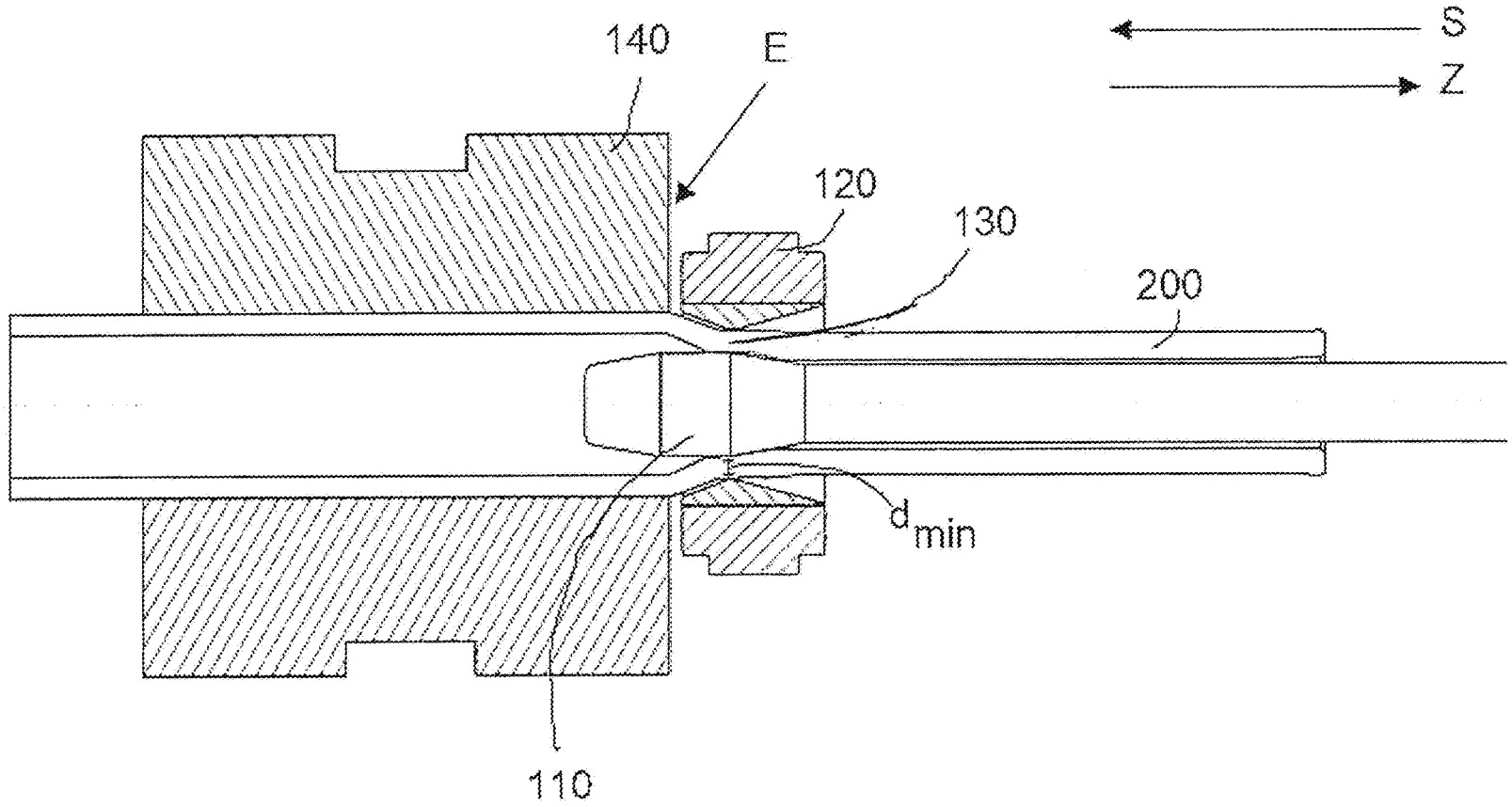
FIG. 4 shows the beginning of a first stretching of the tube beginning from an end position.

In order to reverse this increase in wall thickness, at least in a first partial portion T1 of the free end of the tube 200, the die 120 and the mandrel 110 are moved to their minimum ring spacing $d_{min}$ in a first setting step, resulting in an annular gap setting 130 as shown in FIG. 4. For this purpose, the direction of movement of the mandrel 110 is reversed from the pushing direction S to the opposite pulling direction Z, and the mandrel 110 is moved towards the die 120. To set the minimum annular gap $d_{min}$, as already mentioned, the mandrel 110 is moved relative to the die 120 such that the cylindrical portion 110-III of the mandrel faces the location of the annular die with the smallest annular diameter.

Figure 16:
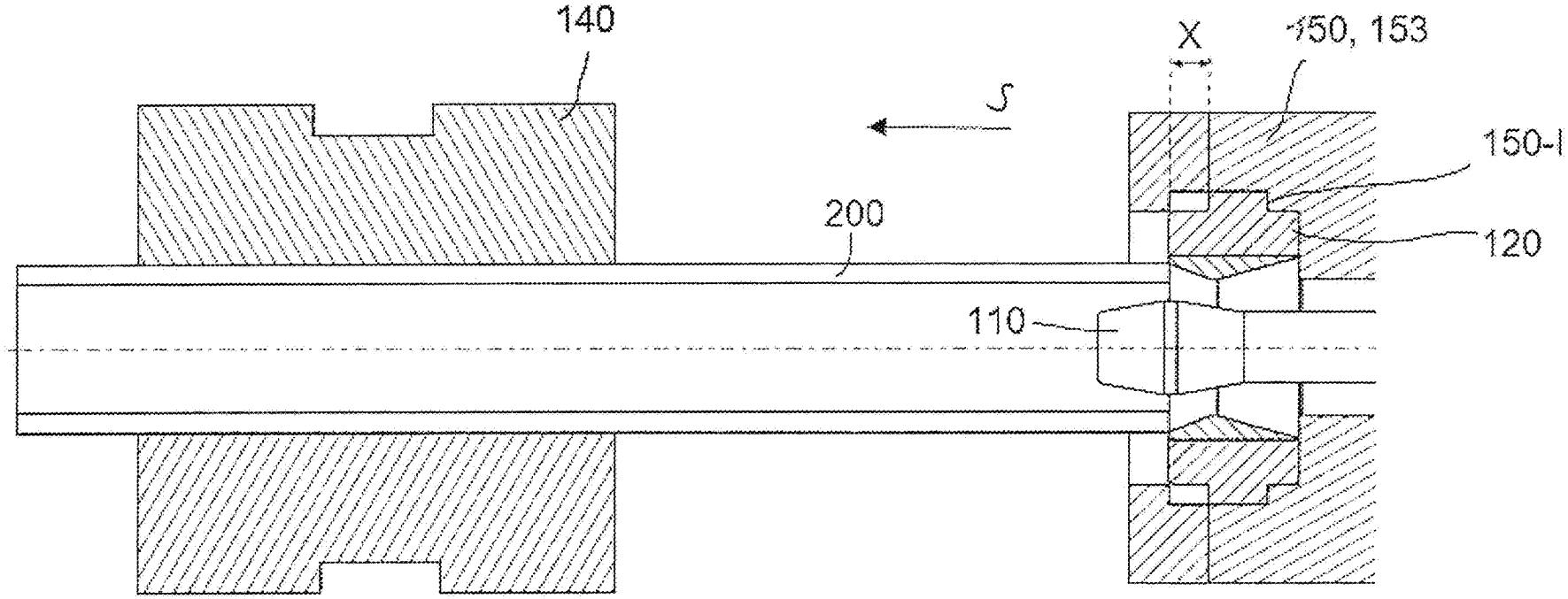
FIG. 16 shows the shaping device with the formation of a forced coupling or forced guidance, as the case may be, for the die at the beginning of a reduction of the outer diameter.
Figure 17:
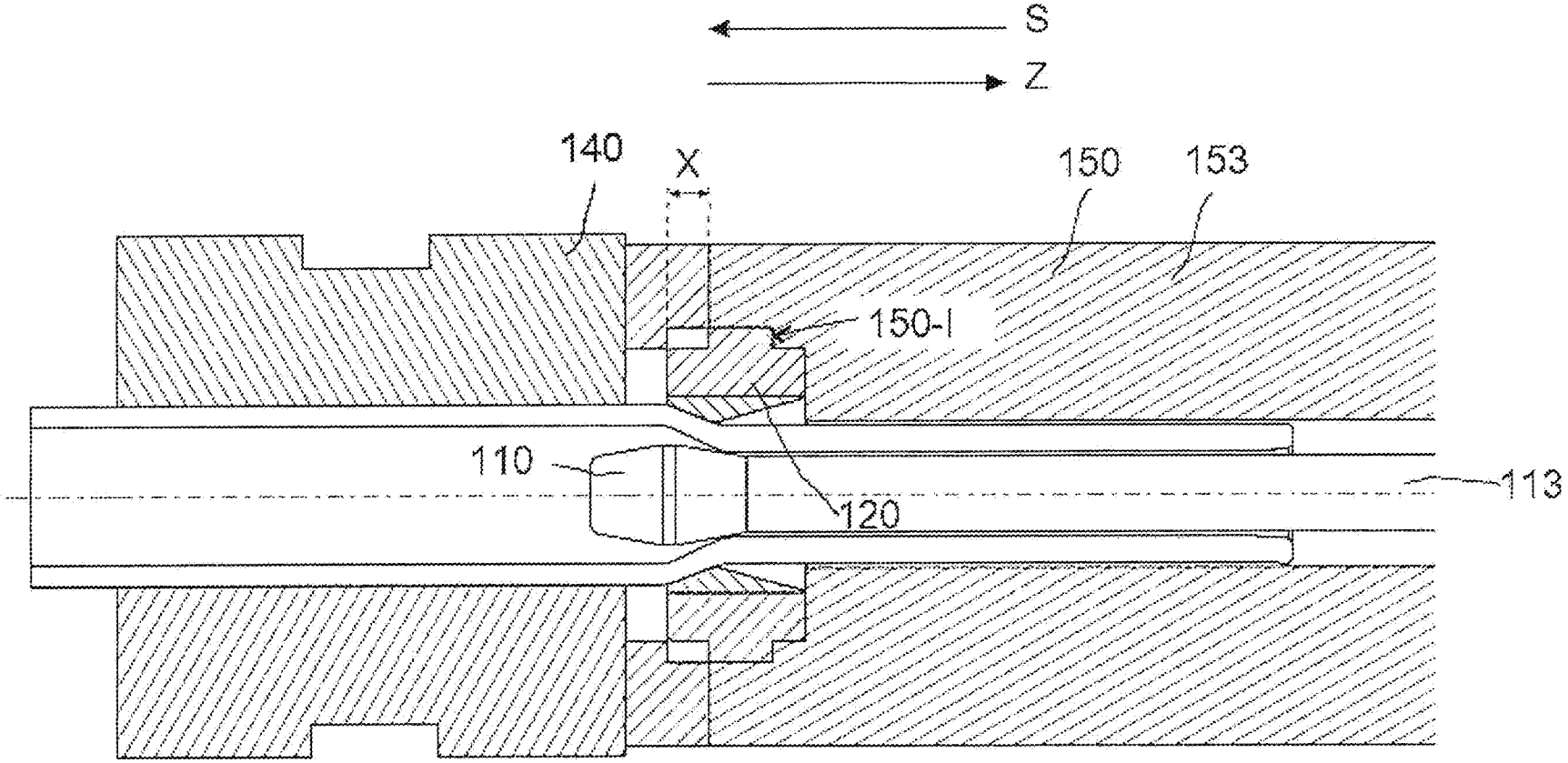
FIG. 17 shows the shaping device moved to an end position in the pushing direction with a left-side stop on a clamping device.
Figure 18:
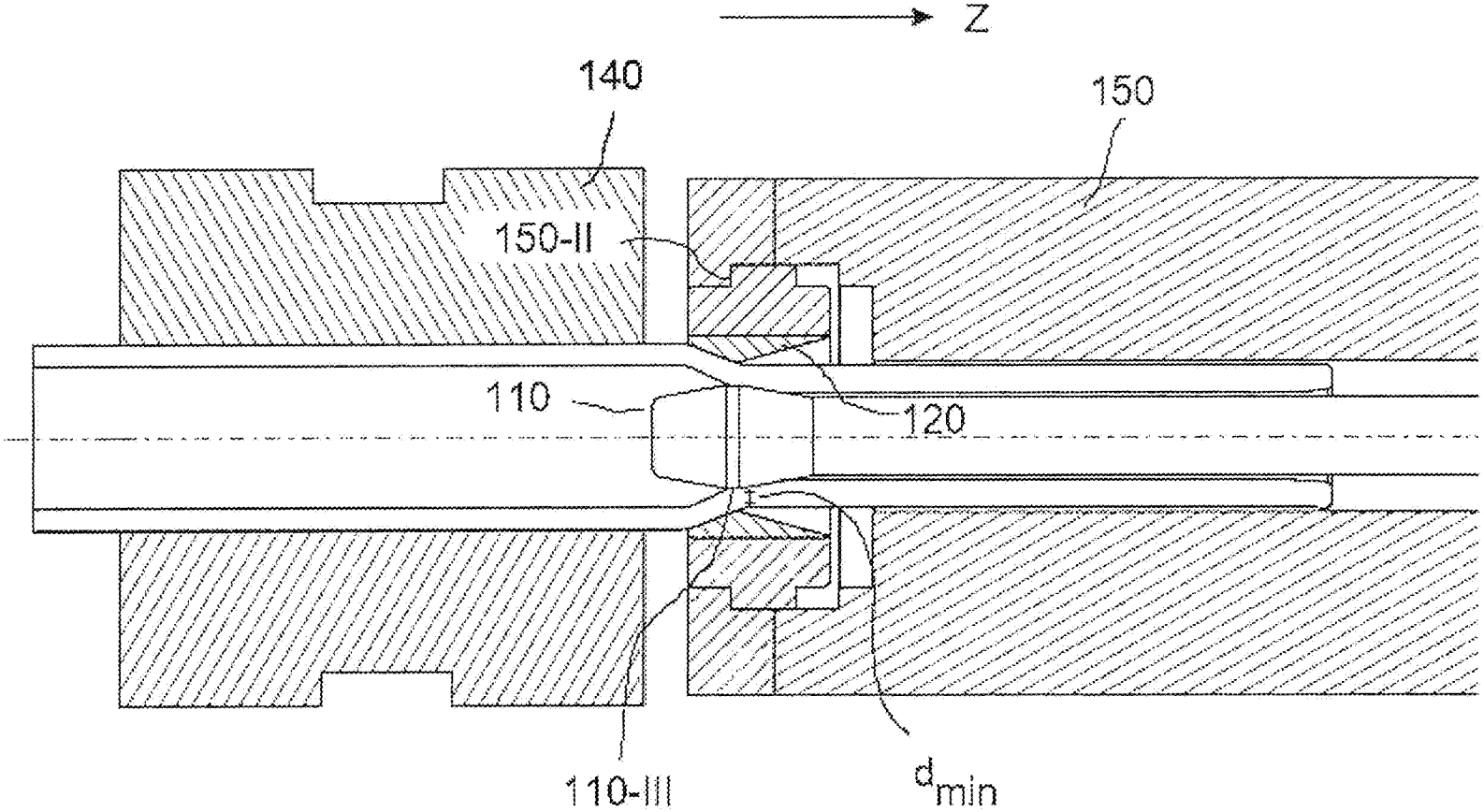
FIG. 18 shows the shaping device after a reversal of its direction of movement in the pulling direction with the die now stopping on the left side.

Such setting of the minimum annular gap by changing the position of the die 120 and the mandrel 110 in relation to one another can be made, on the one hand, electronically or, on the other hand, as shown in FIGS. 16 to 18, with the aid of a mechanical forced coupling of the die 120 and the mandrel 110 within the shaping device 150. A traversing carriage 153 is provided within the shaping device 150 for the axial movement of the die 120 in the pushing and pulling directions. A mandrel bar 113 is arranged coaxially with the traversing carriage 153 for the axial movement of the mandrel 110 in the pushing and pulling direction. With electronic control, the traversing carriage 153 with the die 120 and the mandrel bar 113 with the mandrel 110—electronically controlled—are moved independently of each other in the axial direction.

In the case of forced coupling, the die 120 is mounted in or on, as the case may be, the traversing carriage 153 so as to be displaceable with an axial clearance x in the axial direction. Their movement is limited by two stops 150-I and 150-II in the axial direction. In the initial position shown in FIG. 16 at the beginning of a movement in the pushing direction to reduce the outer diameter, the die 120 strikes the right-side stop 150-I within a traversing carriage 153. From this initial situation, the traversing carriage 153 is moved together with the die 120 and synchronously with the mandrel 110 in the pushing direction S towards the clamping device 140. FIG. 17 shows the stop of the traversing carriage 153 at the clamping device 140. During the specified movement in the pushing direction S, the die 120 always strikes the right-side stop 150-I. In the embodiment of the shaping device with the specified forced coupling, the traversing carriage 153 of the shaping device 150 is mechanically coupled to the mandrel 110 or to the mandrel bar 113, as the case may be. This means that a movement of the carriage 153 in the axial direction is carried out by the mandrel 110 with the mandrel bar 113 in the same way.

When the stop position of the carriage 153 on the clamping device 140 shown in FIG. 17 is reached, the die 120 remains at its right-side stop position 150-I, as already mentioned. At the same time, the mandrel 110 is offset or advanced, as the case may be, to the left relative to the die 120 due to the forced coupling with the traversing carriage 153—as was also the case during the entire previous pushing movement. In order to achieve a change in the setting of the annular gap to the minimum annular gap $d_{min}$ in this situation, the direction of movement of the carriage 153—and coupled with this also the direction of movement of the mandrel 110—is reversed from the pushing direction S to the pulling direction Z, and the traversing carriage 153 initially moves together with the mandrel 110 a short distance in the axial direction according to the axial clearance x. Until then, the position of the die 120 remains unchanged, but the mandrel 110 is moved towards the die 120 in the pulling direction. This changes the annular gap between the die 120 and the mandrel 110. The clearance x is dimensioned such that, in accordance with FIG. 18, the cylindrical portion 110-III of the mandrel 110 moves exactly below the smallest clear diameter of the die 120. In this way, in accordance with FIG. 18, the minimum annular gap $d_{min}$ is preset for the subsequent shaping step of axial stretching.

The minimum ring spacing $d_{min}$ can be less than or equal to the original wall thickness of the tube 200. In any case, in accordance with FIG. 4, it is smaller than the increased wall thickness of the tube 200 due to the reduction of the outer diameter. In this respect, FIG. 4 shows the beginning of a subsequent first shaping step, with which the direction of movement of the die 120 is also reversed from the pushing direction S to the pulling direction Z. Within the framework of such first shaping step, the die 120 and the mandrel 110 are then moved in the pulling direction Z while maintaining the preset minimum ring distance $d_{min}$. Thereby, the specified axial stretching of the tube takes place for the purpose of reducing the increased wall thickness to the size of the annular gap $d_{min}$. Preferably, the die 120 and the mandrel 110 move synchronously. However, the synchronous method is not absolutely necessary during axial stretching; the only prerequisite would be that, when the die 120 and the mandrel 110 move in relation to one another, the region of the smallest inner diameter of the die 120 moves in the region of the cylindrical portion of the mandrel 110, such that the minimum annular gap $d_{min}$ is maintained constant during axial stretching.

Figure 5:
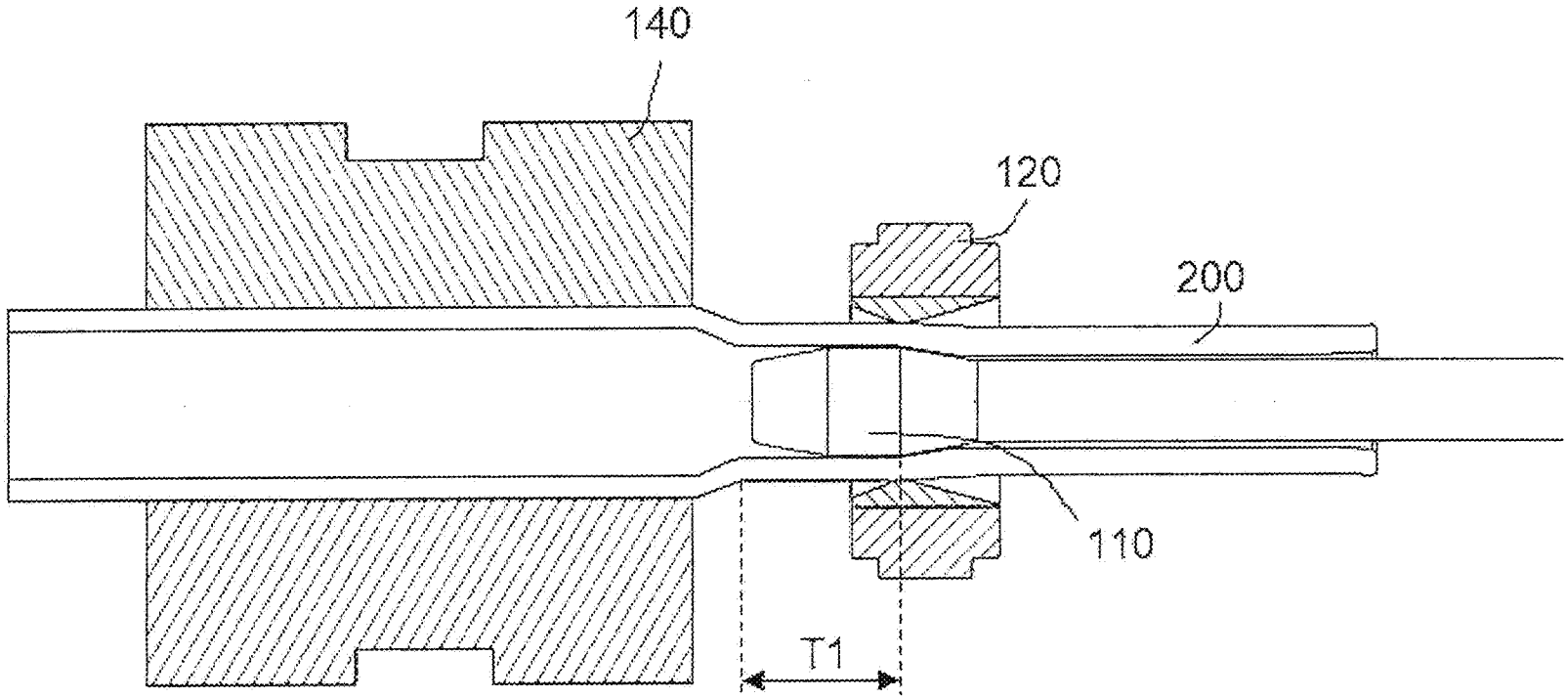
FIG. 5 shows the end of stretching the tube over a first partial portion of the free end of the tube.

FIG. 5 shows the end of axial stretching over the first partial portion T1 of the free tube portion.

Figure 6:
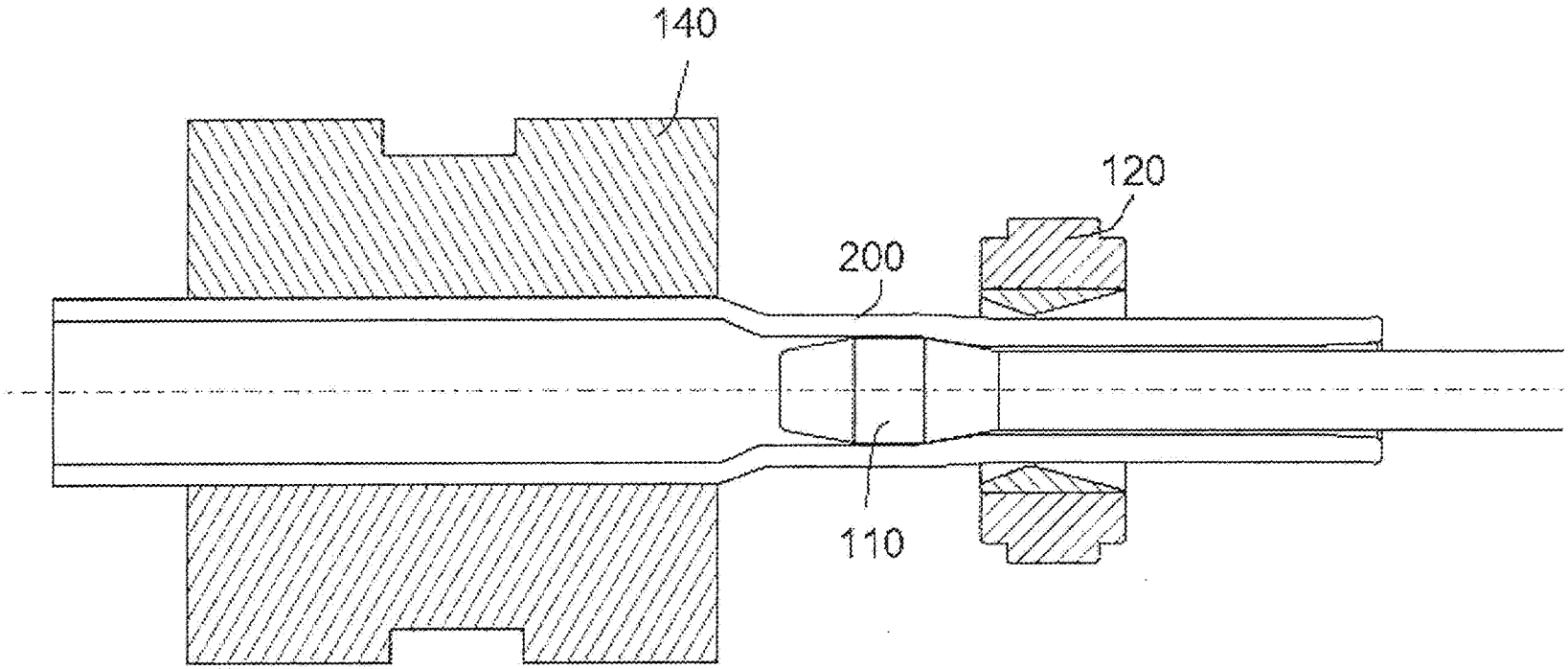
FIG. 6 shows the setting of a negative annular gap at the beginning of the formation of an undercut on the outside of the tube.

At this point, in accordance with FIG. 6, after the first shaping step, a second setting step is performed, with which the annular gap between the die 120 and the mandrel is newly set. Specifically, the annular gap is set negatively here, that is, the setting is made such that the annular gap is spanned by the conical transition portions 110-I of the mandrel 110 and 120-I of the die 120, which taper or converge, as the case may be, towards the free end 215 of the tube 200. Viewed in the vertical direction, such transition portions face each other in regions. The newly set annular gap is located on the rear side of die 120 as viewed in the pulling direction Z. The change in the position of die 120 and mandrel 110 in relation to one another takes place in the region of a tube portion $T_{E2}$ following the first partial portion T1.

The tool pair of die 120 and mandrel 110 is then moved further in the pulling direction Z with this new negative annular-gap setting, and an undercut 220 is formed in the second shaping portion T2 on the outside of the previously thickness-reduced tube.

Figure 7:
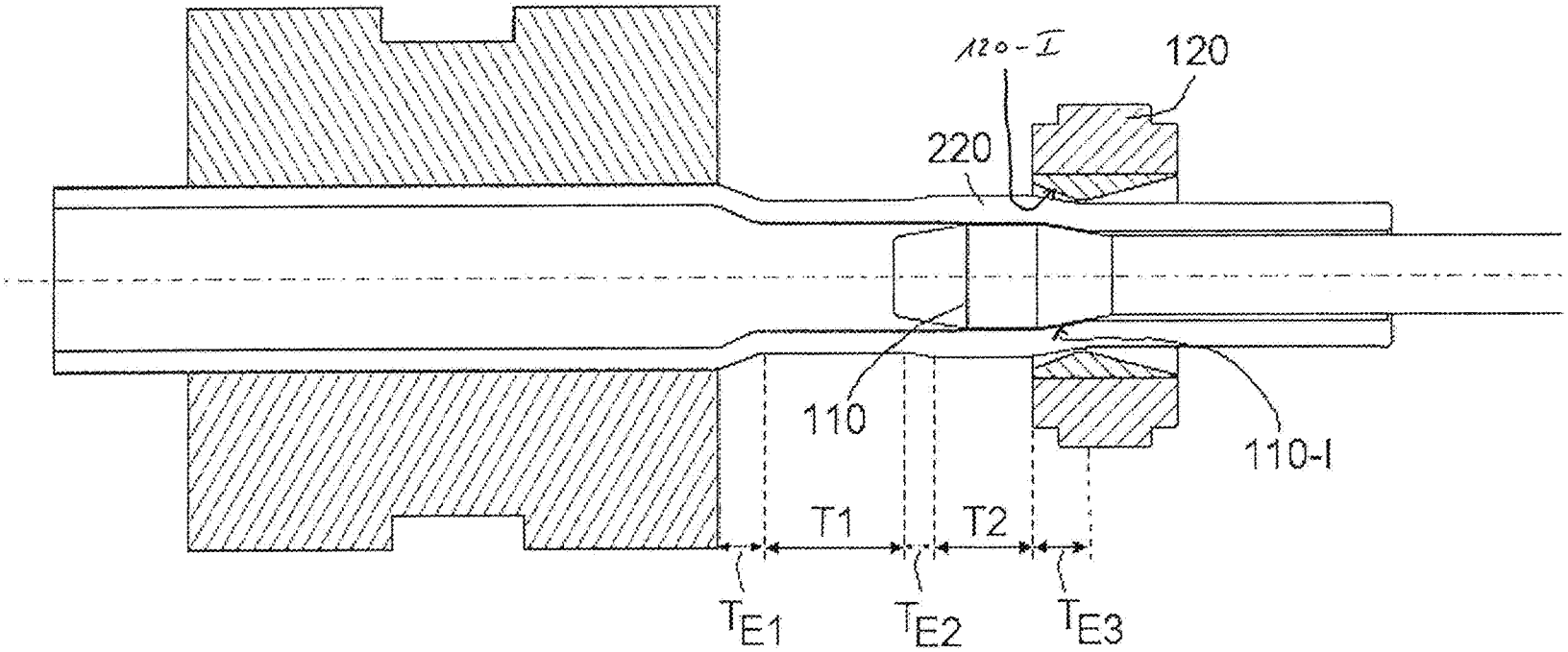
FIG. 7 shows the completion of the formation of the undercut on the outside and the beginning of a second stretching process.

FIG. 7 shows the end of the second shaping portion T2.

At the end of the desired length T2, the die 120 and the mandrel 110 are again set to the minimum ring distance $d_{min}$, that is, moved in relation to one another. This is done via a further setting portion $T_{E3}$; see FIG. 7.

Figure 8:
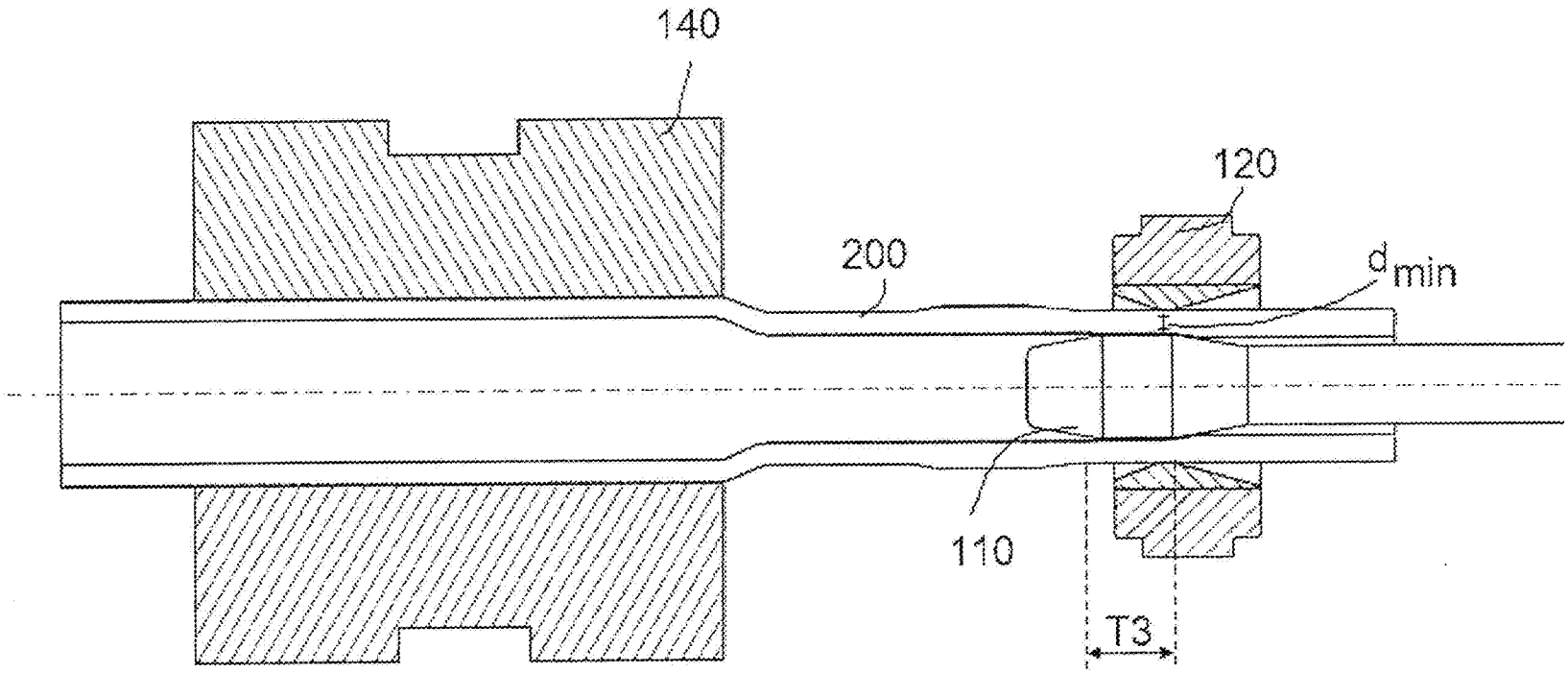
FIG. 8 shows the end of the second stretching process.

In accordance with FIG. 8, the die 120 and mandrel 110 are then moved over a further partial portion T3 of the free tube portion 210 while maintaining the minimum annular gap $d_{min}$. In such third partial portion T3, the tube 200 is again axially stretched to reduce the wall thickness to the minimum annular gap $d_{min}$.

Figure 9:
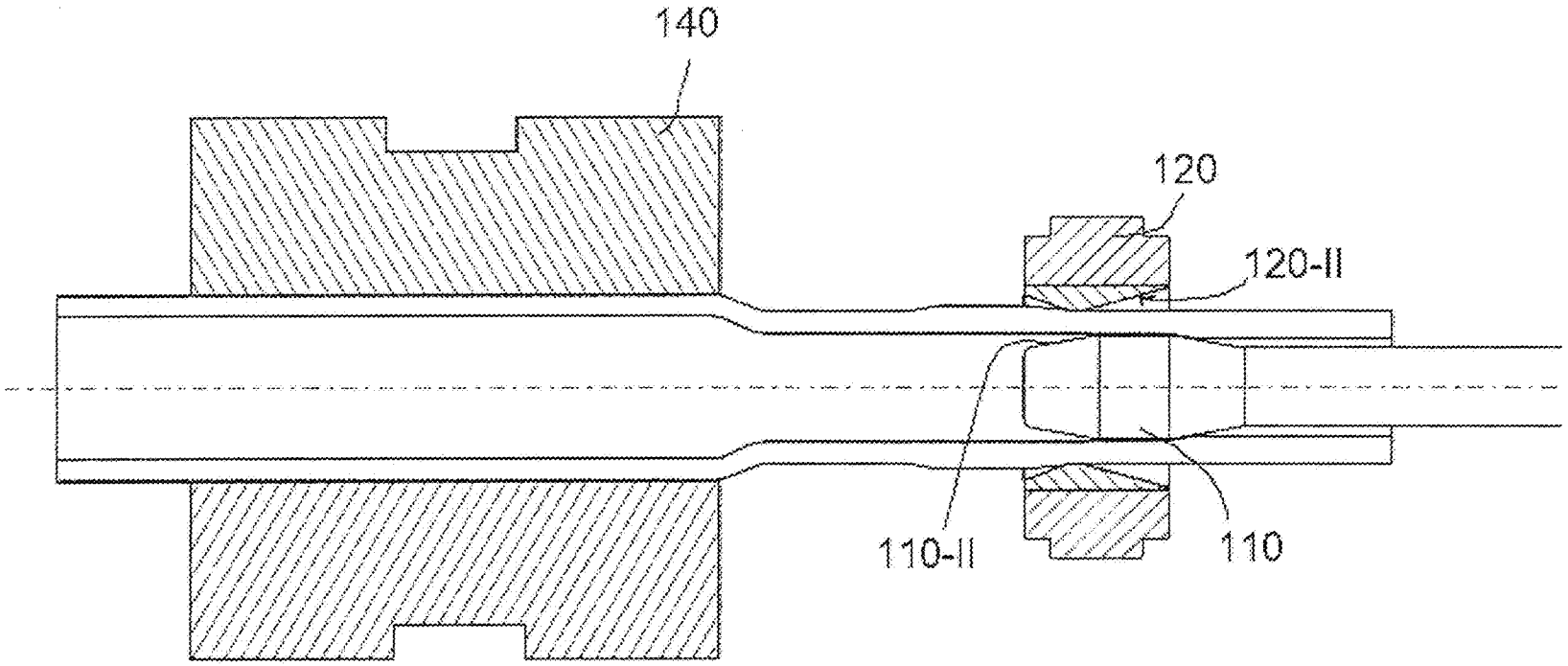
FIG. 9 shows the change of the ring gap setting at the end of the second stretching.
Figure 10:
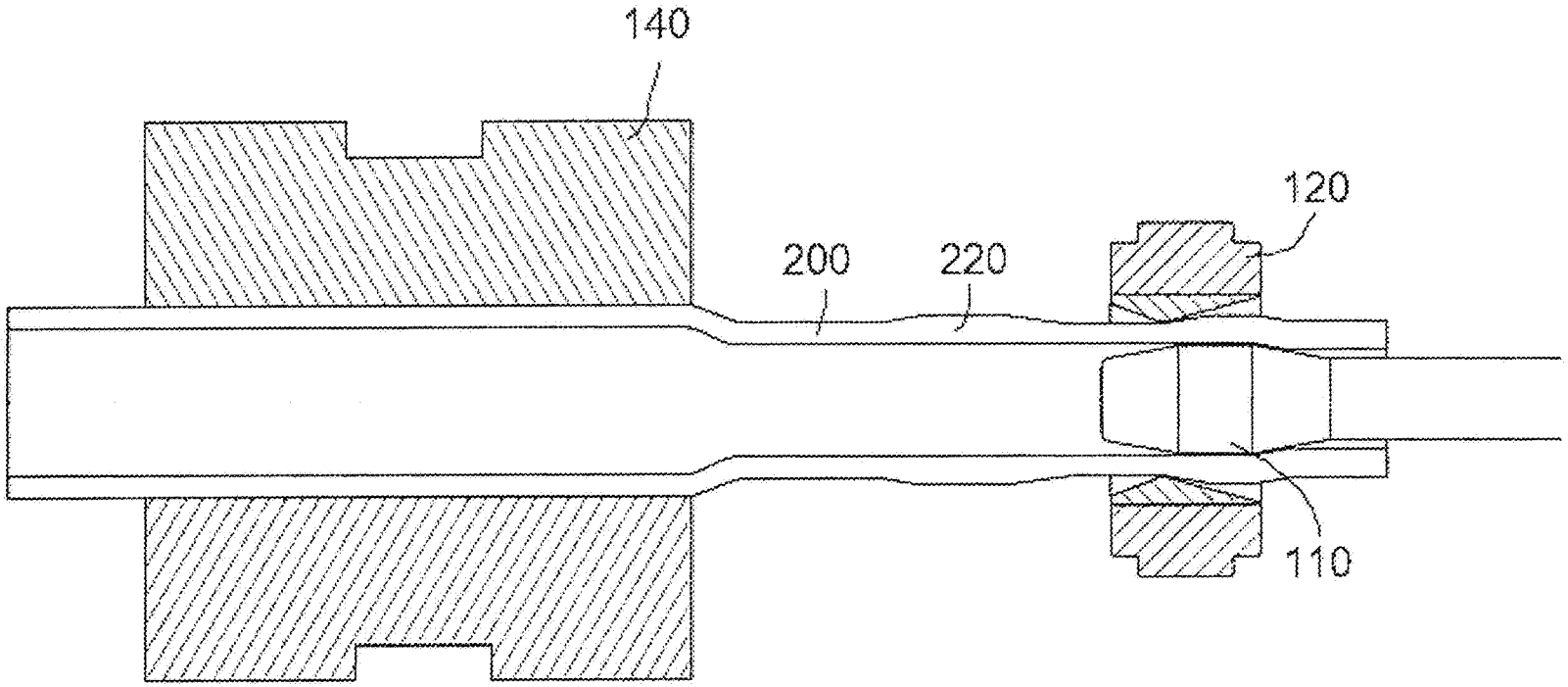
FIG. 10 shows the setting of the annular gap with positive increase to initiate the formation of an undercut inside the tube.

In accordance with FIGS. 9 and 10, the annular-gap setting is then changed again; this time to a positive annular gap. With such positive annular gap, the annular gap is spanned by the conical transition portions 120-II and 110-II of the die 120 and mandrel 120, which are flared towards the free end of the tube 215. With such positive annular-gap setting, the conical transition portions with flaring towards the tube end are generally opposite each other as seen in the vertical direction, at least in sections. The positive annular gap is formed on the front side of the die 120, as viewed in the pulling direction. In accordance with FIG. 9, the positive annular-gap setting is realized by the die 120 temporarily reversing its direction of movement in the pushing direction at the end of the third partial portion T3 and in this way changing its relative position to the stationary mandrel 110, in such a way that the specified positive annular gap is set. However, this way of changing the setting of the annular gap is only exemplary; of course, the relative position at the end of T3 could also be achieved by moving the mandrel 110 further in the pulling direction relative to the die 120, which is stationary, for example, albeit with the use of force. Of course, the movement of both the die 120 and the mandrel 110 in relation to one another would also be conceivable.

Figure 11:
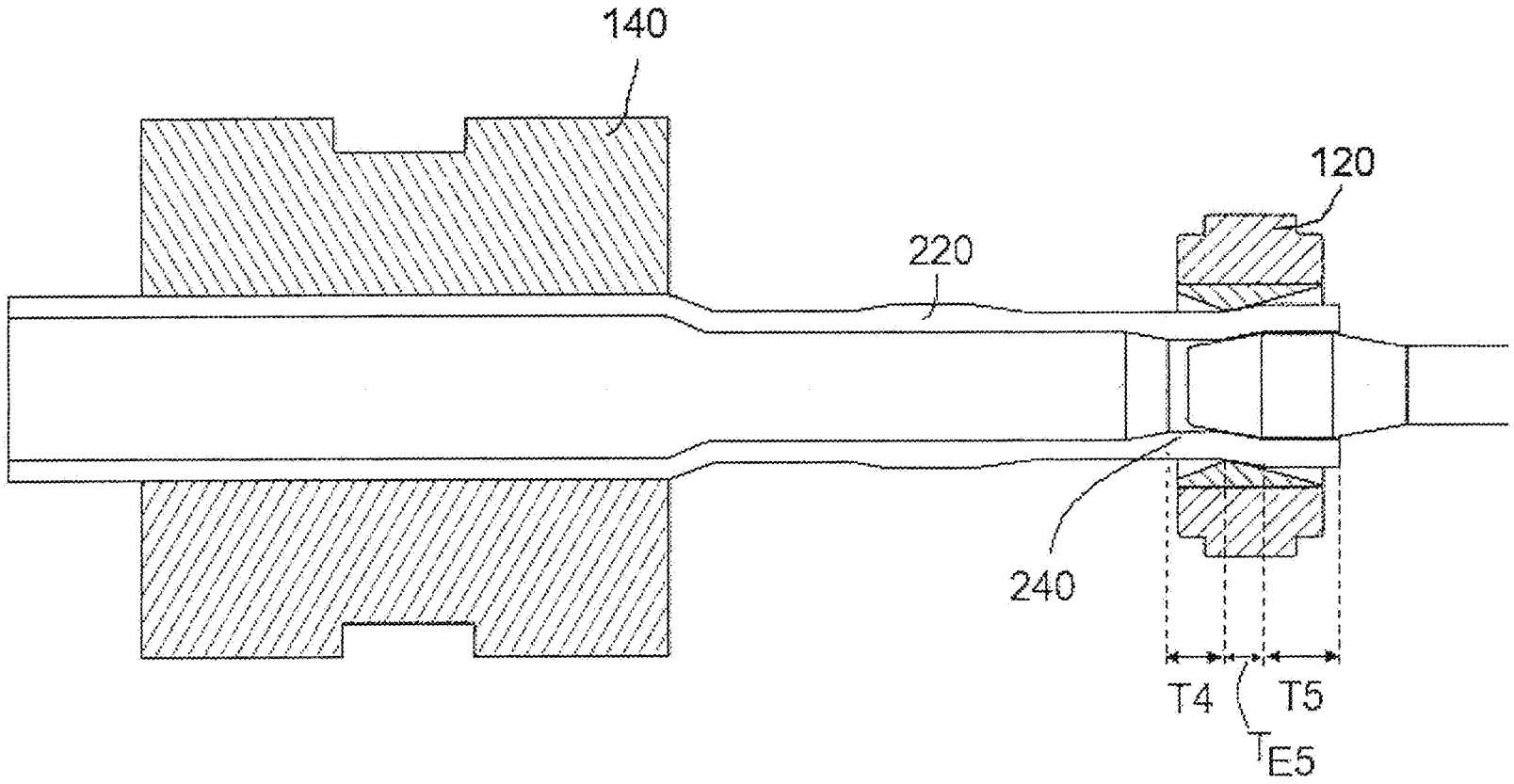
FIG. 11 shows the end of the formation of the undercut inside the tube.
Figure 12:
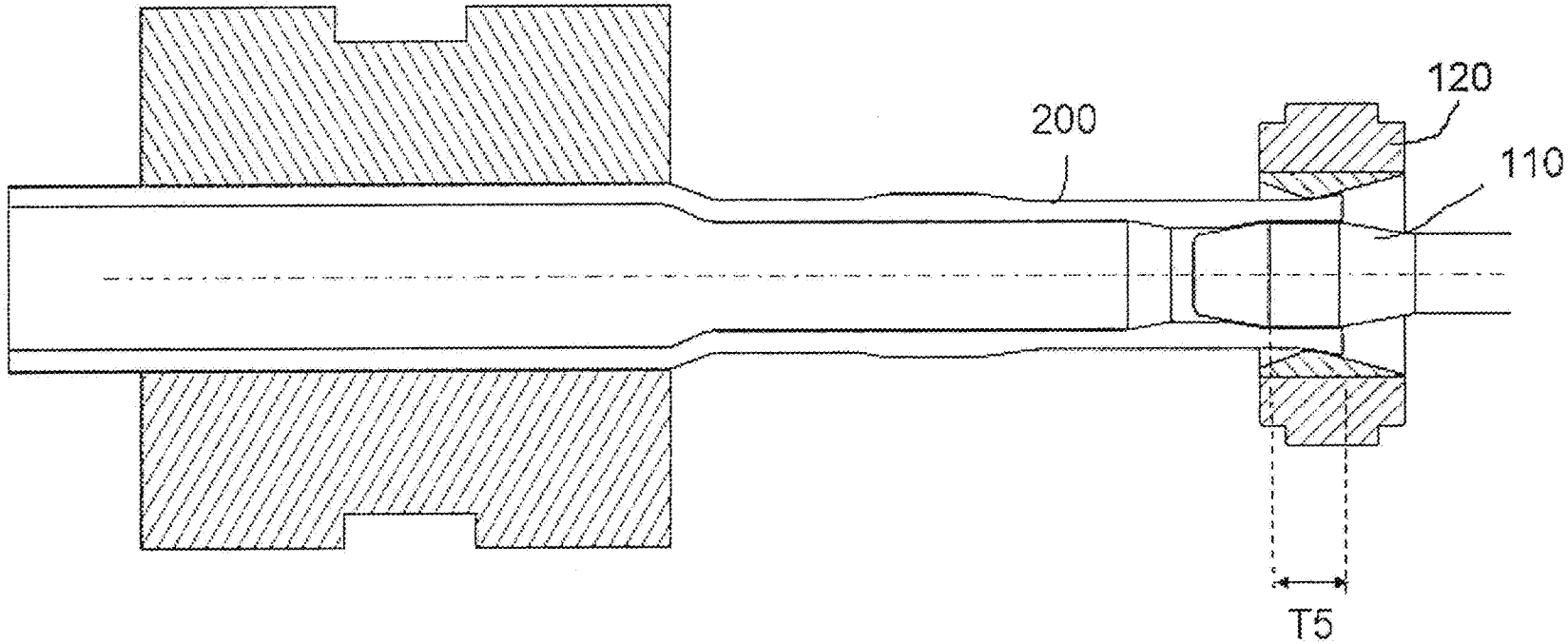
FIG. 12 shows another change in the setting of the annular gap to initiate a third axial stretching operation.
Figure 13:
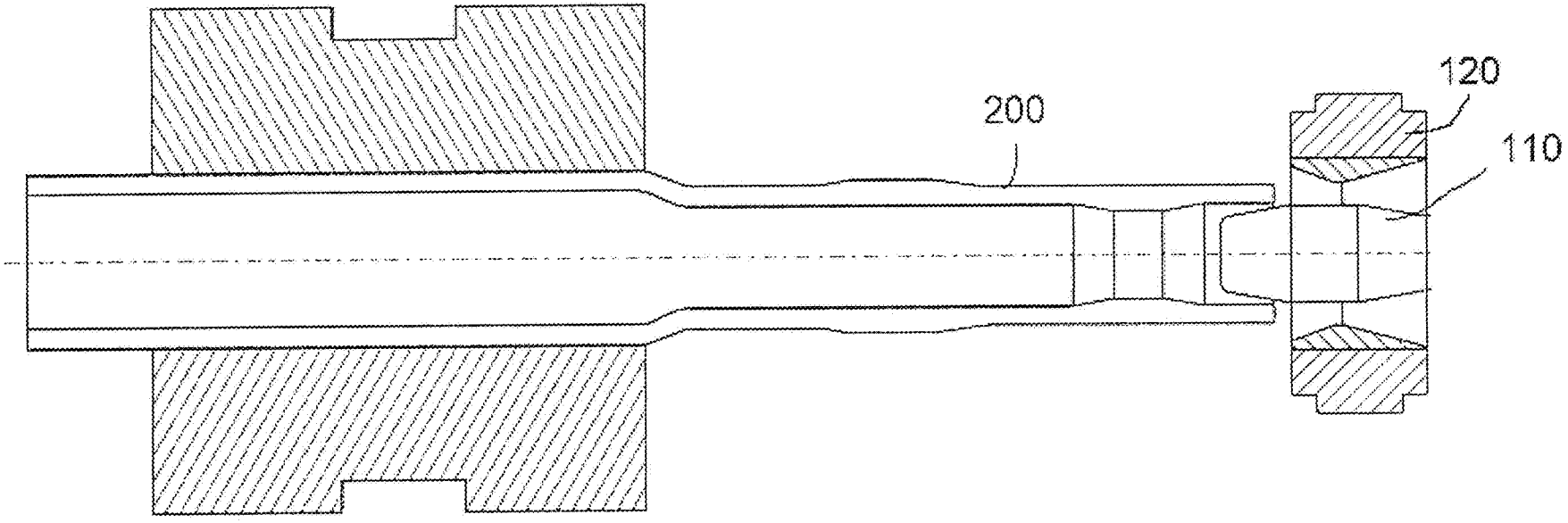
FIG. 13 shows the end of the entire tube shaping with the die removed from the tube and the mandrel largely extracted.

Moving the die 120 and mandrel 110 while maintaining the now set positive annular gap results in the formation of an undercut 240 on the inside of the tube 200, as shown in FIG. 11. The formation of the undercut 220, 240 extends over a partial portion T4 of any desired length. At the end of the fourth partial region T4, the ring gap can again be changed, for example again to the minimum ring gap $d_{min}$. Then, after a further setting portion TE5, a fifth partial portion T5 results again with the axially stretched tube; see FIGS. 12 and 13.

Figure 14:
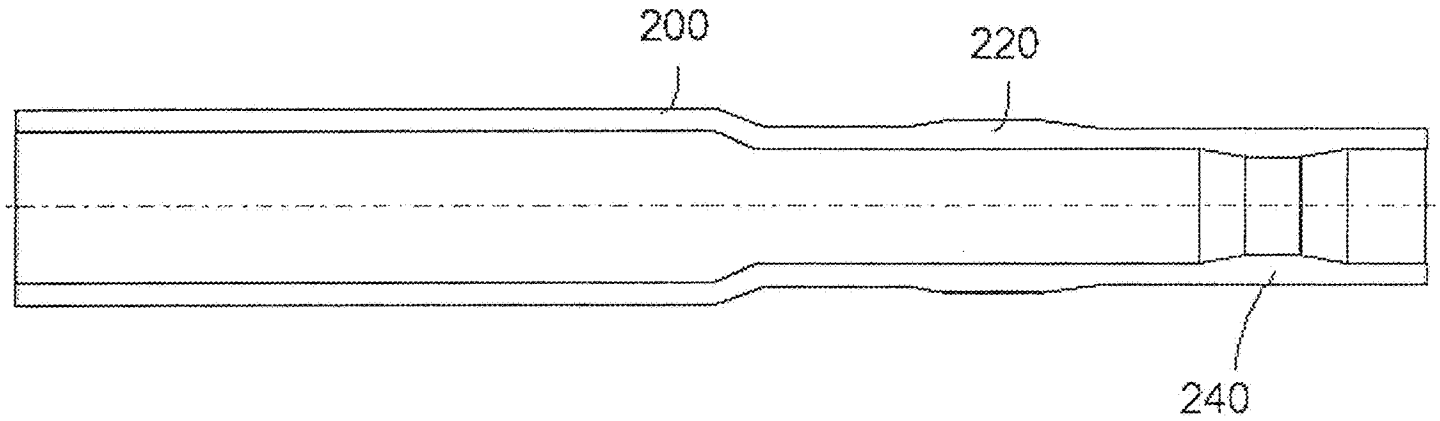
FIG. 14 shows the shaped tube after the shaping steps described above have been carried out.

FIG. 14 shows the finished tube 200 after all the individual steps described above have been carried out.

It is important to mention that the sequence of steps explained here and the final result shown in FIG. 14 are merely exemplary with regard to the machining steps performed. Thus, after the one-time reduction of the outer diameter of the tube 200, any sequences of axial stretching, formation of undercuts 220, 240 on the outside of the tube 200 and formation of undercuts on the inside of the tube 200 are possible. In particular, the sequence of portions with axial stretching and the formation of undercuts 220, 240 proposed here is not mandatory. Rather, formed undercuts 220, 240 on the outside may also be immediately followed by formed undercuts 220, 240 on the inside of the tube 200 in the pulling direction; and vice versa. The partial portions over which the shaping of the tube 200 takes place in each case can in principle be of any length; they are limited only by the length of the free portion 210 of the tube 200. Thus, axial stretching, the formation of an undercut 220, 240 on the outside or the formation of an undercut 220, 240 on the inside of the tube 200 can also take place continuously over the entire free portion 210.

The wall thickness of the tube 200 in the region of an undercut 220, 240 depends on the actual set positive or negative annular distance, that is, the actual distance between the conical transition portions. Due to the electronic setting of the die 120 and the mandrel 110 in relation to one another, this distance and thus the wall thickness in the region of an undercut 220, 240 can be set highly precisely to any desired dimension.

Figure 15:
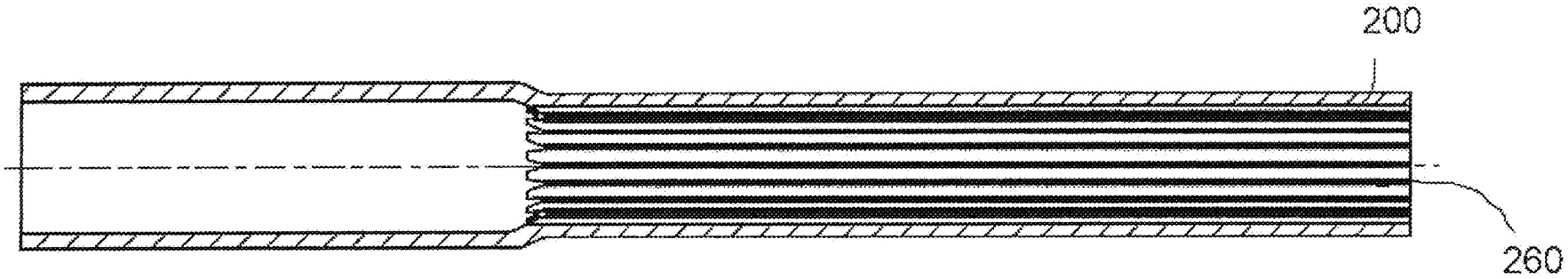
FIG. 15 shows the formation of longitudinal grooves on the inside of the tube by using a mandrel with a gearwheel-shaped cross-section.

FIG. 15 shows an example of the shaped tube 200 when a profiled mandrel 110 is used, specifically when a mandrel 110 with a gearwheel-shaped cross-section is used. In this way, it is then possible to realize, for example, an internal toothings 260 of the tube 200 over a long length in the case of very thin-walled tubes 200. The production of external toothings is also possible when using appropriately profiled ring dies. The forces required, in particular tensile forces, to realize such toothings are significantly lower than using dies 120 and mandrels 110 without any corresponding toothing.

LIST OF REFERENCE SIGNS

110 Mandrel
110-I Axially extending conical transition portion of the mandrel, which is tapered towards the free end of the tube;
110-II Axially extending conical transition portion of the mandrel, which is flared towards the free tube end;
113 Mandrel bar
120 Die
120-I Axially extending conical transition portion of the die, which is tapered towards the free end of the tube
120-II Axially extending conical transition portion of the die, which is flared towards the free tube end
130 Annular gap
140 Clamping device
150 Shaping device
150-I Right-side stop for die
150-II Left-side stop for die
152 Control device
153 Traversing carriage
200 Tube
210 Free portion of the tube
215 Free end of the tube
220 Undercuts on the outside of the tube
240 Undercuts on the inside of the tube
260 Internal toothing of the tube
S Pushing direction Z Pulling direction E End position T1, T2, T3 Partial portions of the free tube portion with shaping $T_{E1}$, $T_{E2}$, $T_{E3}$ Transition portions of the free tube portion for changing the annular-gap setting $D_R$ Original outer diameter of the tube $D_M$ Minimum clear inner diameter of the annular die $d_{min}$ Minimum annular gap

The invention claimed is:

1. A method for axially shaping a tube (200) with a mandrel (110) guided in the tube (200) and an annular die (120) guided on an outside of the tube (200), an inside diameter of the annular die (120) being smaller than an original outside diameter of the tube (200), wherein the annular die (120) has at least one conical transition portion (120-I, 120-II) that extends axially inside the annular die (120), wherein the mandrel (110) has at least one conical transition portion (110-I, 110-II) that extends axially on an outside of the mandrel (110), and wherein the annular die and the mandrel in their juxtaposition span an annular gap (130) for passing through and shaping a wall of the tube (200), the method comprising:

clamping the tube (200) with an original wall thickness in a clamping device (140) such that at least one free portion (210) of the tube (200) remains for shaping the tube (200);

inserting the mandrel (110) into the tube (200);

reducing the original outside diameter of the tube (200) by pushing the annular die (120) in a pushing direction (S) towards the clamping device (140) over the free portion (210) of the tube (200), wherein the mandrel (110) leads the annular die (120) in the pushing direction;

upon reaching an end position (E), reversing the direction of movement of the annular die (120) and the mandrel (110) from the pushing direction (S) to an opposite pulling direction (Z);

moving, in a first setting step, the annular die (120) and mandrel (110) in relation to one another to a first preset annular-gap setting; and moving, in a first shaping step, the annular die (120) and mandrel (110) in the pulling direction (Z) over a first partial portion (T1) of the free tube portion (210), while maintaining the first preset annular-gap setting, moving, in a subsequent second setting step, the annular die (120) and mandrel (110) in relation to one another to a negative annular-gap setting, in which the conical transition portions (110-I, 120-I) of the annular die (120) and the mandrel (110) taper towards a free end of the tube (200) and span the annular gap; and moving, in a second shaping step, the annular die (120) and mandrel (110) in the pulling direction (Z) over a second partial portion (T2) of the free tube portion (210), while maintaining the second preset annular-gap setting, thereby causing an outer diameter of the tube in the second partial portion (T2) to be greater than an outer diameter of the tube in the first partial portion (T1).

2. The method according to claim 1, wherein, after the second shaping step, one or more further setting steps and subsequent shaping steps are performed, wherein, in each further setting step, the annular die (120) and the mandrel (110) are set to a further annular-gap setting, which differs from a previous annular-gap setting.

3. The method according to claim 2, wherein the mandrel (110) has a cylindrical portion (110-III) in addition to the at least one conical transition portion (110-I, 110-II) on the outside of the mandrel (110); and wherein in at least one of the setting steps the annular die (120) and the mandrel (110) are set in relation to one another to a minimum vertical annular distance by arranging a narrowest point of the annular die opposite the cylindrical portion (110-III) of the mandrel (110).

4. The method according to claim 3, further comprising, in a subsequent shaping step after setting the annular die (120) and the mandrel (110) to the minimum vertical annular distance, axially stretching the tube (200) in a pulling direction (Z) to a wall thickness which corresponds to the minimum vertical annular distance.

5. The method according to claim 2, wherein in at least one of the setting steps, the annular die (120) and mandrel (110) are moved in relation to one another to a positive annular-gap setting, in which the conical transition portions (110-II, 120-II) of the annular die (120) and mandrel (110) flare towards the free end of the tube (200) and span the annular gap at a front side of the annular die.

6. The method according to claim 2, wherein in at least one of the setting steps, the annular die (120) is stopped and the mandrel (110) is moved relative to the annular die (120).

7. The method according to claim 2, wherein in at least one of the setting steps the movement of the annular die (120) and the mandrel (110) in relation to one another is performed by moving the mandrel (110) while the annular die (120) continues to move continuously in the pulling direction (Z).

8. The method according to claim 2, wherein in at least one of the shaping steps, the annular die (120) and the mandrel (110) are moved synchronously.

9. The method according to one claim 2, wherein, in one of the setting steps, the annular die (120) and the mandrel (110) are set in relation to one another to a minimum vertical annular distance by arranging a narrowest point of the annular die the opposite a cylindrical portion (110-III) of the mandrel (110), wherein, in the subsequent shaping step, a stretching of the tube (200) is performed, and wherein, in the subsequent further setting step, a negative annular-gap setting is made, such that, in the subsequent further shaping step, an undercut (220) is formed on the outside of the tube (200); or wherein, in the subsequent further setting step, a positive annular-gap setting is made, such that, in the subsequent further shaping step, an undercut (240) is formed on the inside of the tube (200).

10. The method according to claim 9, wherein, after the undercuts (220, 240) are formed, a setting step is again performed to set a minimum annular gap; and wherein, in a subsequent further shaping step, the stretching of the tube (200) takes place.

11. An apparatus for axially shaping a tube (200), comprising a clamping device (140) for clamping the tube (200), such that a free portion (320) remains;

a shaping device (150) axially aligned with the clamping device (140) and having an axially displaceable annular die (120) and a mandrel (110) coaxially guided within the annular die (120), wherein the annular die (120) and the mandrel each have a conical axially extending transition portion (110-I, 110-II, 120-I, 120-II), wherein the annular die (120) and the mandrel (110) in their juxtaposition span an annular gap for passing through and shaping the wall of the tube (200); and a controller (152) allocated to the shaping device (150) for moving the annular die (120) and the mandrel (110) independently of each other along the free portion of the tube (200) for shaping the tube (200) in a pushing direction (S) and a pulling direction (Z), wherein the controller (152) is configured to perform the following steps:

pushing the annular die (120) in a pushing direction (S) towards the clamping device (140) over the free portion (210) of the tube (200) while the mandrel (110) leads the annular die (120) in the pushing direction and thereby reducing an original outside diameter of the tube (200);

upon reaching an end position (E), reversing the direction of movement of the annular die (120) and the mandrel (110) from the pushing direction (S) to an opposite pulling direction (Z);

moving, in a first setting step, the annular die (120) and mandrel (110) in relation to one another to a first preset annular-gap setting;

moving, in a first shaping step, the annular die (120) and mandrel (110) in the pulling direction (Z) over a first partial portion (T1) of the free tube portion (210), while maintaining the first preset annular-gap setting;

moving, in a subsequent second setting step, the annular die (120) and mandrel (110) in relation to one another to a negative annular-gap setting, in which the conical transition portions (110-I, 120-I) of the annular die (120) and the mandrel (110) taper towards a free end of the tube (200) and span the annular gap; and moving, in a second shaping step, the annular die (120) and mandrel (110) in the pulling direction (Z) over a second partial portion (T2) of the free tube portion (210), while maintaining the second preset annular-gap setting, thereby causing an outer diameter of the tube in the second partial portion T2) to be greater than an outer diameter of the tube in the first partial portion (T1).

12. The apparatus according to claim 11, wherein the mandrel (110) is profiled in a longitudinal direction with a gearwheel-shaped cross-section.

* * * * *